US010354596B2

(12) United States Patent
Zhang et al.

(10) Patent No.: US 10,354,596 B2
(45) Date of Patent: Jul. 16, 2019

(54) PIXEL CIRCUIT AND DRIVE METHOD THEREFOR, AND ACTIVE MATRIX ORGANIC LIGHT-EMITTING DISPLAY

(71) Applicant: KUNSHAN GO-VISIONOX OPTO-ELECTRONICS CO., LTD., KunShan, Jiangsu (CN)

(72) Inventors: Jiuzhan Zhang, KunShan (CN); Xiujian Zhu, KunShan (CN)

(73) Assignee: KUNSHAN GO-VISIONOX OPTO-ELECTRONICS CO., LTD., Jiangsu (CN)

( * ) Notice: Subject to any disclaimer, the term of this patent is extended or adjusted under 35 U.S.C. 154(b) by 32 days.

(21) Appl. No.: 15/539,502

(22) PCT Filed: Dec. 1, 2015

(86) PCT No.: PCT/CN2015/096080
§ 371 (c)(1),
(2) Date: Jun. 23, 2017

(87) PCT Pub. No.: WO2016/107363
PCT Pub. Date: Jul. 7, 2016

(65) Prior Publication Data
US 2017/0352316 A1 Dec. 7, 2017

(30) Foreign Application Priority Data
Dec. 30, 2014 (CN) ..... 2014 1 0843247

(51) Int. Cl.
*G09G 3/3291* (2016.01)
*G09G 3/3233* (2016.01)
*G09G 3/32* (2016.01)

(52) U.S. Cl.
CPC ..... *G09G 3/3291* (2013.01); *G09G 3/32* (2013.01); *G09G 3/3233* (2013.01);
(Continued)

(58) Field of Classification Search
None
See application file for complete search history.

(56) References Cited

U.S. PATENT DOCUMENTS

2010/0164847 A1 7/2010 Lee et al.
2010/0177125 A1* 7/2010 Miwa ..... G09G 3/3233 345/690
(Continued)

FOREIGN PATENT DOCUMENTS

CN 101866614 A 10/2010
CN 103460276 A 12/2013
(Continued)

*Primary Examiner* — Joseph R Haley
*Assistant Examiner* — Emily J Frank
(74) *Attorney, Agent, or Firm* — Muncy, Geissler, Olds & Lowe, P.C.

(57) ABSTRACT

A pixel circuit and a drive method therefor, and an active matrix organic light-emitting display. The pixel circuit initializes an anode of an organic light-emitting diode (OLED) through a seventh thin-film transistor (M7), so that the aging of the organic light-emitting diode (OLED) is slowed down and the service life of the organic light-emitting diode (OLED) is prolonged. The current output by a first thin-film transistor (M1) serving as a drive element is determined by a data voltage provided by a data line (Dm) and an initialization voltage (Vref) provided by a third power supply and has nothing to do with external supply voltages and a threshold voltage of the first thin-film transistor (M1), and therefore brightness non-uniformity caused by the deviation in the threshold voltage of the thin-film transistor and the change in the supply voltages can be avoided. Therefore, the active matrix organic light-emitting display which uses the pixel circuit and the drive method therefor prolongs the service life, and improves the display quality.

20 Claims, 4 Drawing Sheets

(52) U.S. Cl.
CPC ..... *G09G 2300/0819* (2013.01); *G09G 2300/0852* (2013.01); *G09G 2300/0861* (2013.01); *G09G 2320/0233* (2013.01); *G09G 2320/043* (2013.01)

(56) References Cited

U.S. PATENT DOCUMENTS

| | | | | |
|---|---|---|---|---|
| 2011/0164016 | A1 | 7/2011 | Kang et al. | |
| 2011/0164018 | A1 | 7/2011 | Kang et al. | |
| 2012/0001896 | A1* | 1/2012 | Han | G09G 3/3233 345/214 |
| 2013/0069852 | A1* | 3/2013 | Liao | G09G 3/3233 345/77 |
| 2014/0353608 | A1 | 12/2014 | Kim et al. | |
| 2015/0287362 | A1* | 10/2015 | Lee | G09G 3/3233 345/77 |

FOREIGN PATENT DOCUMENTS

| | | | |
|---|---|---|---|
| CN | 103745690 | A | 4/2014 |
| CN | 104167171 | A | 11/2014 |
| CN | 104200771 | A | 12/2014 |
| CN | 104464641 | A | 3/2015 |
| EP | 2146337 | A1 | 1/2010 |
| EP | 2261884 | A1 | 12/2010 |
| EP | 2806421 | A1 | 11/2014 |
| JP | 2014-235426 | A | 12/2014 |
| WO | WO 2006/103797 | A1 | 10/2006 |
| WO | WO 2013/076774 | A1 | 5/2013 |
| WO | WO2013069560 | A1 | 5/2013 |

* cited by examiner

PIXEL CIRCUIT AND DRIVE METHOD THEREFOR, AND ACTIVE MATRIX ORGANIC LIGHT-EMITTING DISPLAY

TECHNICAL FIELD

The present invention relates to the field of flat panel display devices and, in particular, to a pixel circuit and a method for driving it, as well as to an active matrix organic light-emitting diode (AMOLED) display device.

BACKGROUND

Organic light-emitting diode (OLED) display devices utilize OLEDs to display images. Such display devices are active devices which differ from traditional thin-film-transistor liquid-crystal display (TFT-LCD) devices in actively emitting light and not requiring backlight. They have many advantages such as high contrast, fast response and small thickness, and are praised as display devices of the next generation that will replace the TFT-LCD devices.

Depending on how they are driven, OLED display devices can be categorized into passive matrix organic light-emitting diode (PMOLED) devices and active matrix organic light-emitting diode (AMOLED) devices.

An AMOLED display device comprises scan lines, data lines and an array of pixels defined by the scan lines and data lines. Each of the pixels in the array includes an OLED and a pixel circuit that drives the OLED. Reference is now made to FIG. 1, which is a diagram showing a pixel circuit in an AMOLED display device of the prior art. As shown in FIG. 1, the conventional pixel circuit 10 generally includes a switch thin-film transistor T1, a drive thin-film transistor T2 and a capacitor Cs. The switch transistor T1 is connected to a scan line S(n). When the switch transistor T1 is turned on via the scan line S(n), a data voltage $V_{data}$ provided by a data line is stored via the switch transistor T1 in the capacitor Cs, thereby causing the drive transistor T2 to produce a current which drives the OLED to emit light.

The brightness of the pixel is determined by the current flowing through the OLED, and the current is in turn under the control of the pixel circuit. In this conventional pixel circuit, the current flowing through the OLED is affected by a threshold voltage of the drive transistor and a power supply voltage VDD applied to the pixel circuit. Upon a change occurring in the threshold voltage of the drive transistor or in the power supply voltage VDD, the current flowing through the OLED may undergo a significant variation which can lead to the OLED emitting light with a different brightness level from those of other OLEDs in response to their corresponding data signals which, however, indicate the same brightness level. Therefore, it is difficult for this conventional AMOLED display device to display an image with uniform brightness.

Therefore, there is an urgent need in this art for a solution to address the problem of low brightness uniformity of conventional AMOLED display devices.

SUMMARY OF THE INVENTION

It is an object of the present invention to overcome the problem of low brightness uniformity arising from the use of conventional AMOLED display devices by presenting a pixel circuit and a method for driving it, as well as an active matrix organic light-emitting diode (AMOLED) display device.

This object is attained by a pixel circuit including:

a first thin-film transistor, which is connected between a second node and an anode of an organic light-emitting diode (OLED) and has a gate connected to a first node;

a second thin-film transistor, which is connected between the first node and a third node and has a gate connected to an emission control line;

a third thin-film transistor, which is connected between the third node and a third power source and has a gate connected to an initialization control line;

a fourth thin-film transistor, which is connected between a first power source and the second node and has a gate connected to a scan line;

a fifth thin-film transistor, which is connected between a data line and the first node and has a gate connected to the scan line;

a sixth thin-film transistor, which is connected between the first power source and the second node and has a gate connected to the emission control line;

a seventh thin-film transistor, which is connected between the third power source and the anode of the OLED and has a gate connected to the initialization control line;

a first capacitor connected between the first node and the third node; and a second capacitor connected between the third node and the second node.

Optionally, a cathode of the OLED may be connected to a second power source, wherein the first power source and the second power source are provided to drive the OLED; and the third power source is configured to provide an initialization voltage.

Optionally, the initialization voltage may be a negative voltage.

Optionally, the first through the seventh thin-film transistors may be all p-type thin-film transistors.

Optionally, the current provided by the first thin-film transistor to the OLED may be determined by a data voltage provided by the data line and the initialization voltage provided by the third power source and be independent of the power supply voltages provided by the first power source and the second power source, as well as of a threshold voltage of the first thin-film transistor.

Optionally, the fourth thin-film transistor and the fifth thin-film transistor may be controlled via the scan line, wherein the third thin-film transistor and the seventh thin-film transistor are controlled via the initialization control line and the second thin-film transistor and the sixth thin-film transistor are controlled via the emission control line.

Accordingly, the present invention also provides a method for driving the pixel circuit, including: a scan period including a first period of time, a second period of time and a third period of time, wherein in the first period of time, a scan signal provided by the scan line and a control signal provided by the initialization control line both shift from a high level to a low level and a control signal provided by the emission control line jumps from the low level to the high level, leading to the third thin-film transistor, the fourth thin-film transistor, the fifth thin-film transistor and the seventh thin-film transistor being turned on, the data voltage provided by the data line being supplied to the first node via the fifth thin-film transistor, and the third node and the anode of the OLED being initialized by the third power source;

in the second period of time, the control signal provided by the initialization control line is maintained at the low level, the control signal provided by the emission control line is maintained at the high level and the scan signal provided by the scan line shifts from the low level to the high level, leading to the fourth thin-film transistor and the fifth thin-film transistor being turned off, the writing of the data voltage being ended, and a sampling of the threshold voltage of the first thin-film transistor M1 being completed; and in the third period of time, the scan signal provided by the scan line is maintained at the high level, the control signal provided by the initialization control line jumps from the low level to the high level and the control signal provided by the emission control line drops from the high level to the low level, leading to the third thin-film transistor and the seventh thin-film transistor being turned off, the second thin-film transistor and the sixth thin-film transistor being turned on, and the first thin-film transistor outputting a current which drives the OLED to emit light.

Optionally, in the first period of time, the first power source may be connected to the second node via the fourth thin-film transistor, wherein a voltage at the second node is equal to the voltage provided by the first power source.

Optionally, in the third period of time, the first capacitor may be shorted wherein a voltage difference between the gate and a source of the first thin-film transistor is equal to a voltage stored in the second capacitor.

Accordingly, the present invention also provides an active matrix organic light-emitting diode (AMOLED) display device including the pixel circuit as defined above.

In the pixel circuit and the method for driving it, as well as the AMOLED display device, by initializing the anode of the OLED through the seventh thin-film transistor, aging of the OLED is slowed and the service life thereof is extended. In addition, as the current output by the first thin-film transistor which serves as a drive element is determined by the data voltage provided by the data line and the initialization voltage provided by the third power source and is independent of the external power supply voltages and the threshold voltage of the first thin-film transistor, brightness non-uniformity that may arise from variations in thin-film transistor threshold voltages and power supply voltage changes can be overcome. Therefore, use of the pixel circuit and the method for driving it, as well as the AMOLED display device can result in not only service life extension but also an improvement in display quality.

DETAILED DESCRIPTION

Pixel circuits and methods for driving them, as well as active matrix organic light-emitting diode (AMOLED) display devices, according to the present invention, will be described below in greater detail with reference to specific embodiments and the accompanying drawings. The advantages and feature of the invention will become more apparent from the following description and the appended claims. It is noted that the drawings are presented in a very simplified form not precisely drawn to scale with the only purpose of facilitating the description of the embodiments of the invention.

Figure 1:
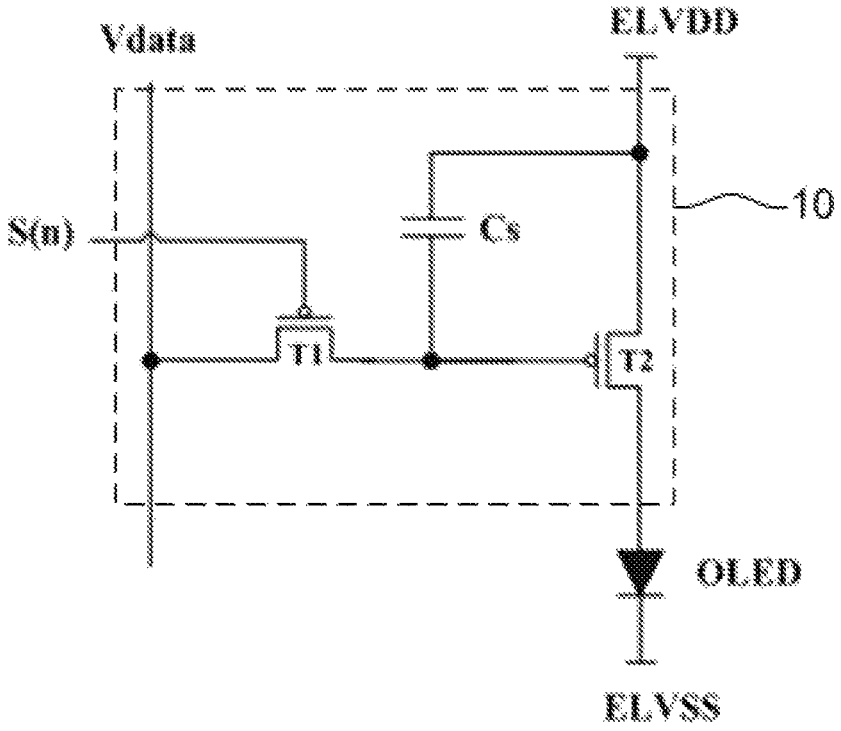
FIG. 1 is a schematic diagram showing a pixel circuit in an AMOLED display device of the prior art.
Figure 2:
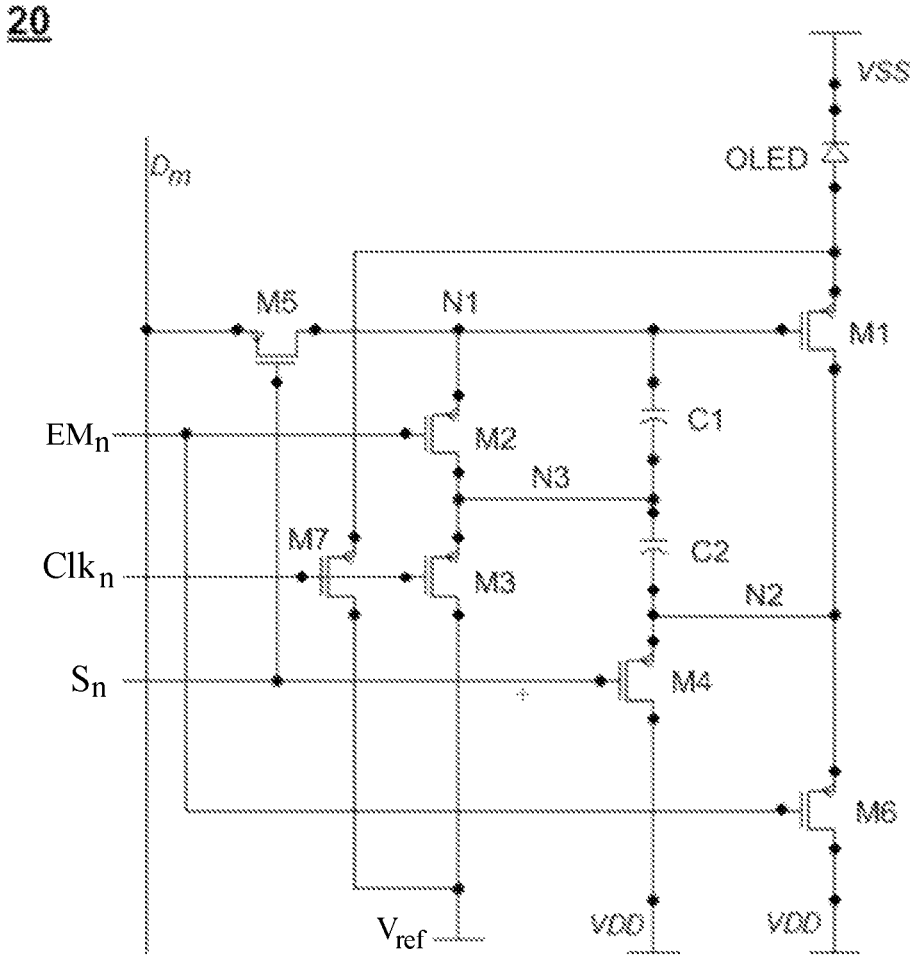
FIG. 2 is a schematic illustration of a pixel circuit according to an embodiment of the present invention.

Reference is now made to FIG. 2, which shows a schematic illustration of a pixel circuit according to an embodiment of the present invention. As shown in FIG. 2, the pixel circuit 20 includes: a first thin-film transistor M1, which is connected between a second node N2 and an anode of an organic light-emitting diode OLED and has a gate connected to a first node N1; a second thin-film transistor M2, which is connected between the first node N1 and a third node N3 and has a gate connected to an emission control line $EM_n$; a third thin-film transistor M3, which is connected between the third node N3 and a third power source and has a gate connected to an initialization control line $Clk_n$; a fourth thin-film transistor M4, which is connected between a first power source and the second node N2 and has a gate connected to a scan line $S_n$; a fifth thin-film transistor M5, which is connected between a data line $D_m$ and the first node N1 and has a gate connected to the scan line $S_n$; a sixth thin-film transistor M6, which is connected between the first power source and the second node N2 and has a gate connected to the emission control line $EM_n$; a seventh thin-film transistor M7, which is connected between the third power source and the anode of the organic light-emitting diode OLED and has a gate connected to the initialization control line $Clk_n$; a first capacitor C1 connected between the first node N1 and the third node N3; and a second capacitor C2 connected between the third node N3 and the second node N2.

In particular, a cathode of the organic light-emitting diode OLED is connected to a second power source, and the pixel circuit 20 and the organic light-emitting diode OLED are provided with the first power source, the second power source and the third power source externally (e.g., from a power supply). The first power source and the second power source are provided to drive the organic light-emitting diode OLED, and serve to provide a first power supply voltage VDD and a second power supply voltage VSS, respectively. The third power source is configured to provide an initialization voltage $V_{ref}$. In general, the first power source has a high level, while the second power source and the third power source both have a low level. In this embodiment, the initialization voltage $V_{ref}$ provided by the third power source is a negative voltage.

As shown in FIG. 2, the pixel circuit 20 controls the fourth thin-film transistor M4 and the fifth thin-film transistor M5 via the scan line $S_n$, the third thin-film transistor M3 and the seventh thin-film transistor M7 via the initialization control line $Clk_n$, and the second thin-film transistor M2 and the sixth thin-film transistor M6 via the emission control line $EM_n$.

Upon a scan signal provided by the scan line $S_n$ transitioning to the low level, the fourth thin-film transistor M4 and the fifth thin-film transistor M5 are both turned on, leading to supply of a data voltage $V_{data}$ provided by the data line $D_m$ to the first node N1 via the fifth thin-film transistor M5 and application of the first power supply voltage VDD provided by the first power source to the second node N2 via the fourth thin-film transistor M4.

When a control signal provided by the initialization control line $Clk_n$ transitions to the low level, the third thin-film transistor M3 and the seventh thin-film transistor M7 are both turned on, leading to the initialization voltage $V_{ref}$ provided by the third power source being supplied to the third node N3 and the anode of the organic light-emitting diode OLED via the third thin-film transistor M3 and the seventh thin-film transistor M7, respectively.

When a control signal provided by the emission control line $EM_n$ transitions to the low level, the second thin-film transistor M2 and the sixth thin-film transistor M6 are both turned on, causing the first thin-film transistor M1 to be turned on and provide a current which drives the organic light-emitting diode OLED to emit light having a brightness level corresponding to the magnitude of the current. This allows an image to be displayed.

In this embodiment, the pixel circuit 20 is implemented as a 7T2C circuit including the seven thin-film transistors and the two capacitors, wherein the seven thin-film transistors are all p-type thin-film transistors, with the first thin-film transistor M1 serving as a drive transistor, the third thin-film transistor M3 and the seventh thin-film transistor M7 being controlled by the initialization control line $Clk_n$ which is configured for initialization control, the fourth thin-film transistor M4 and the fifth thin-film transistor M5 being controlled by the scan line $S_n$ which is configured for the control of writing of the data voltage $V_{data}$ and sampling of the threshold voltage of the drive transistor, and the second thin-film transistor M2 and the sixth thin-film transistor M6 being controlled by the emission control line $EM_n$ which is configuration for control of light-emission of the organic light-emitting diode OLED.

The initialization voltage $V_{ref}$ provided by the third power source is applied to the anode of the organic light-emitting diode OLED via the seventh thin-film transistor M7, allowing for the initialization of the anode of the organic light-emitting diode OLED and hence resulting in service life extension of the organic light-emitting diode OLED and the drive thin-film transistor M1.

In addition, the current of the organic light-emitting diode OLED provided by the first thin-film transistor M1 is determined by the data voltage $V_{data}$ provided by the data line $D_m$ and the initialization voltage $V_{ref}$ provided by the third power source and is independent of the power supply voltages provided by the first power source and the second power source, as well as of the threshold voltage of the first thin-film transistor M1. Therefore, use of the pixel circuits 20 can avoid brightness non-uniformity caused by variations in threshold voltages of the thin-film transistors and changes in the power supply voltages and thus enable improved display quality of a display device in which the pixel circuits are used.

Accordingly, the present invention also provides a method for driving the pixel circuit, comprising:

a scan period including a first period of time t1, a second period of time t2 and a third period of time t3, wherein:

in the first period of time t1, the scan signal provided by the scan line $S_n$ and the control signal provided by the initialization control line $Clk_n$ shift from the high level to the low level and the control signal provided by the emission control line $EM_n$ jumps from the low level to the high level, leading to the third thin-film transistor M3, the fourth thin-film transistor M4, the fifth thin-film transistor M5 and the seventh thin-film transistor M7 being turned on, the data voltage $V_{data}$ provided by the data line $D_m$ being supplied to the first node N1 via the fifth thin-film transistor M5, and the third node N3 and the anode of the organic light-emitting diode OLED being initialized by the third power source;

in the second period of time t2, the control signal provided by the initialization control line $Clk_n$ is maintained at the low level, the control signal provided by the emission control line $EM_n$ is maintained at the high level and the scan signal provided by the scan line $S_n$ shifts from the low level to the high level, leading to the fourth thin-film transistor M4 and the fifth thin-film transistor M5 being turned off, the writing of the data voltage $V_{data}$ being ended, and the sampling of the threshold voltage of the first thin-film transistor M1 being completed; and in the third period of time t3, the scan signal provided by the scan line $S_n$ is maintained at the high level, the control signal provided by the initialization control line $Clk_n$ jumps from the low level to the high level and the control signal provided by the emission control line $EM_n$ drops from the high level to the low level, leading to the third thin-film transistor M3 and the seventh thin-film transistor M7 being turned off, the second thin-film transistor M2 and the sixth thin-film transistor M6 being turned on, and the first thin-film transistor M1 outputting a current which drives the OLED to emit light.

Specifically, in the first period of time t1, following the fifth thin-film transistor M5 being turned on, the data voltage $V_{data}$ provided by the data line $D_m$ is written to the first node N1 via the fifth thin-film transistor M5, so that a voltage $V_{N1}$ at the first node N1 is equal to $V_{data}$. After the fourth thin-film transistor M4 is turned on, the first power source is connected to the second node N2 via the fourth thin-film transistor M4, so that a voltage $V_{N2}$ at the second node N2 is equal to VDD. In this process, the third power source provides the initialization voltage $V_{ref}$ to the anode of the organic light-emitting diode OLED via the seventh thin-film transistor M7, and thereby initializing the anode of the organic light-emitting diode OLED. This slows the aging of the organic light-emitting diode OLED and extends its service life. In addition, the third power source also provides the initialization voltage $V_{ref}$ to the third node N3 via the third thin-film transistor M3, thereby initializing the third node N3. With the initialization being completed, a voltage at the anode of the organic light-emitting diode OLED and a voltage $V_{N3}$ at the third node N3 are both equal to $V_{ref}$.

In the second period of time t2, following the fifth thin-film transistor being turned off, the writing of the data voltage $V_{data}$ provided by the data line $D_m$ to the first node N1 is terminated, so that the voltage $V_{N1}$ at the first node N1 is equal to the data voltage $V_{data}$. As the fourth thin-film transistor M4 is turned off, the voltage $V_{N2}$ at the second node N2 is pulled down to $V_{data}+|Y_{th}|$, while the voltage $V_{N3}$ at the third node N3 remains equal to $V_{ref}$. As the second capacitor C2 is connected between the third node N3 and the second node N2, a voltage stored in the second capacitor C2 is equal to $V_{data}+|Y_{th}|-V_{ref}$, where $V_{th}$ represents the threshold voltage of the first thin-film transistor M1. In this way, the threshold voltage of the first thin-film transistor M1 is stored in the second capacitor C2, completing the sampling of the threshold voltage of the first thin-film transistor M1.

In the third period of time t3, following the seventh thin-film transistor M7 being turned off, the third power source can no longer provide the initialization voltage $V_{ref}$ to the anode of the organic light-emitting diode OLED via the seventh thin-film transistor M7, and the initialization of the anode of the organic light-emitting diode OLED is therefore terminated. At the same time, as the second thin-film transistor M2 is turned on, the first capacitor C1 is shorted. As a result, a gate-source voltage $V_{sg}1$ of the first thin-film transistor M1, i.e., a voltage difference between the gate and source of the first thin-film transistor M1, equals the voltage stored in the second capacitor C2. We can thus obtain the gate-source voltage $V_{sg}1$ of the first thin-film transistor M1 as:

$$V_{sg}1=V_{data}+|V_{th}|-V_{ref} \quad \text{Eqn. 1.}$$

In this process, as the sixth thin-film transistor M6 is turned on, the first power supply voltage VDD provided by the first power source is transmitted to the first thin-film transistor M1 via the sixth thin-film transistor M6, leading to the first thin-film transistor M1 being turned on. As a result, a current follows a path leading from the first power source and passing through the sixth thin-film transistor M6, the first thin-film transistor M1 and the organic light-emitting diode OLED to reach the second power source, making the organic light-emitting diode OLED emit light. That is, in the third period of time t3, the pixels emit light to display an image.

The current $I_{on}$ flowing through the organic light-emitting diode OLED is calculated as:

$$\text{Ion}=K\times(V_{sg}1-|V_{th}|)^2 \quad \text{Eqn. 2,}$$

wherein, K is the product of the electron mobility, aspect ratio and capacitance per unit area of the thin-film transistor.

From Eqns. 1 and 2, we can obtain:

$$\text{Ion}=K\times(V_{data}-V_{ref})^2 \quad \text{Eqn. 3.}$$

As indicated by Eqn. 3, the current flowing through the organic lighting emitting diode OLED is independent of the power supply voltages and the threshold voltage of the first thin-film transistor M1, and is related only to the data voltage $V_{data}$, the initialization voltage $V_{ref}$ and the constant K. Therefore, even if there were changes in the power supply voltages or in the threshold voltages of the first thin-film transistors M1, the currents $I_{on}$ in the organic lighting emitting diodes OLED would not be affected at all. Thus, the problem of non-uniform brightness arising from threshold voltage variations and power wiring impedances can be overcome by use of the pixel circuit 20 and the method for driving it. At the same time, the services lives of the organic lighting emitting diodes OLED and the first thin-film transistors M1 that serve as drive transistors can also be extended.

Figure 4:
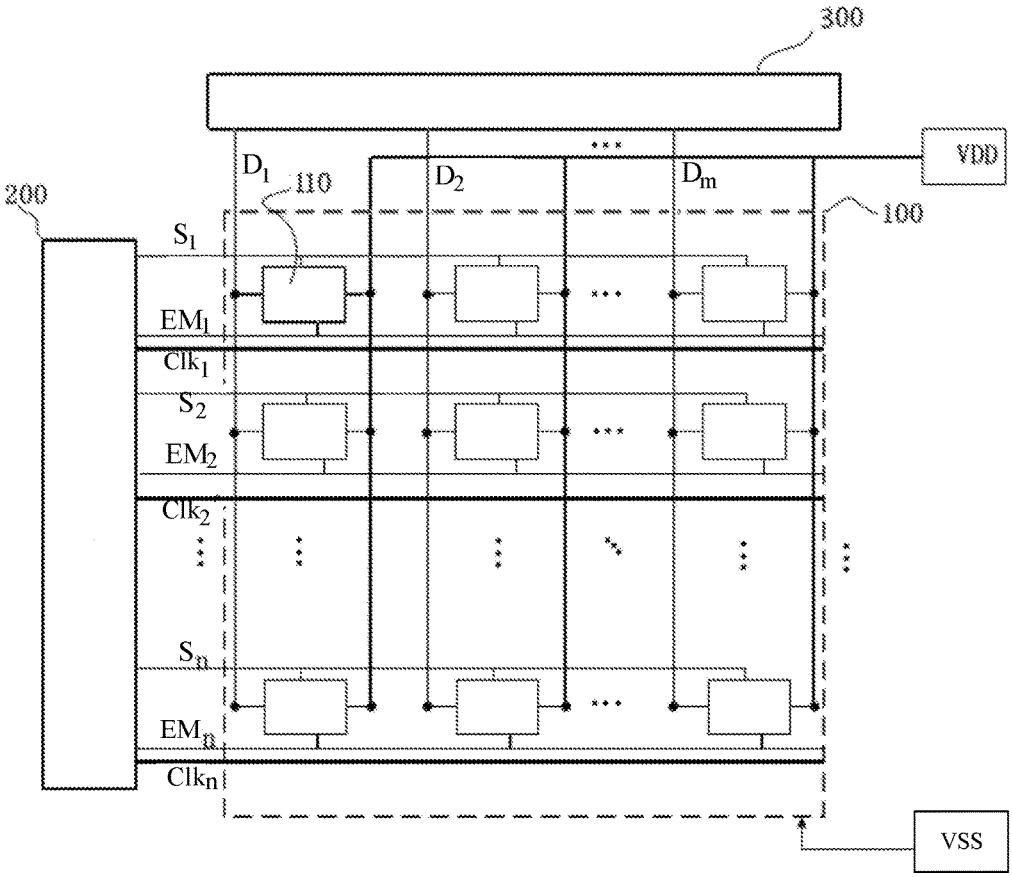
FIG. 4 schematically illustrates an AMOLED display device according to the present invention.

Accordingly, the present invention also provides an active matrix organic light-emitting diode (AMOLED) display device. As shown in FIG. 4, the AMOLED display device comprises: display unit 100, a scan driver 200 and a data driver 300. The display unit 100 includes a plurality of pixels 110 which are disposed at intersections between scan lines $S_1$-$S_n$ and data lines $D_1$-$D_m$ in a matrix. Each of the plurality of pixels 110 is connected to a corresponding one of the scan lines and a corresponding one of the data lines and comprises a pixel circuit 20 as defined above.

Specifically, the display unit 100 is provided with the first power source VDD and the second power source VSS externally (e.g., from a power supply). The first power source VDD and the second power source VSS serve as a high level voltage source and a low level voltage source, respectively, and are configured to drive the pixels 110.

As shown in FIG. 4, the display unit 100 includes the plurality of pixels 110 which are arranged in an m×n matrix, wherein m is a number of columns of the pixel 110, n is a number of rows thereof, m≥1 and n≥1. Each of the pixels 110 is connected to a corresponding one of the scan lines and a corresponding one of the data lines (each of the scan lines is connected to a correspondingly numbered one of the rows of the pixels 110, and each of the data lines is connected to a correspondingly numbered one of the columns of the pixels 110). For example, a pixel 110 in the i-th row and j-th column is connected to an i-th scan line $S_i$ and a j-th data line $D_j$.

Each of the scan lines is connected to the scan driver 200 which is configured to generate scan control signals in response to external scan control signals (e.g., from timing control units). The scan control signals generated by the scan driver 200 are sequentially provided to the pixels 110 via the respective scan lines $S_1$-$S_n$. Each of the data lines is connected to the data driver 300 which is configured to produce data signals in response to external data and data control signals (e.g., from timing control units). The data signals produced by the data driver 300 are provided to the pixels 110 via the data lines $D_1$-$D_m$ concurrently with the scan signals.

Figure 3:
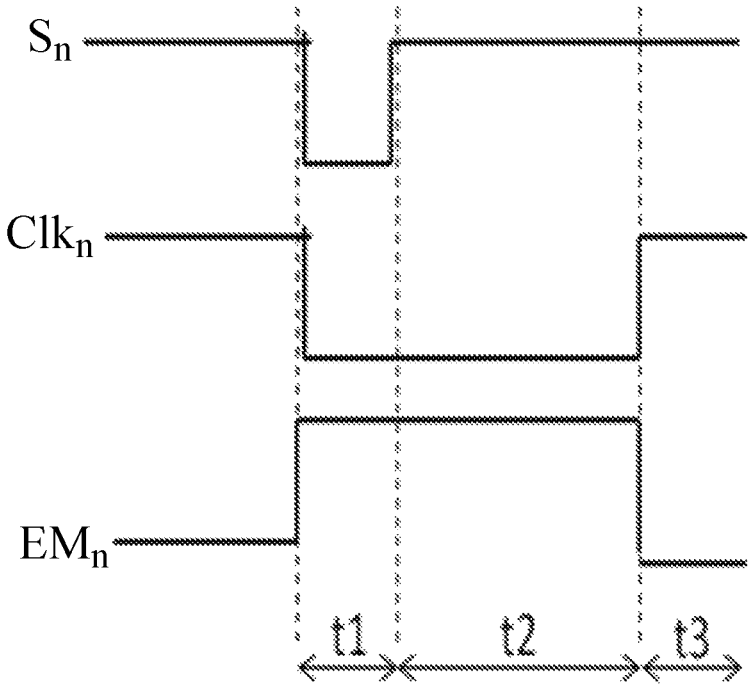
FIG. 3 is a timing diagram illustrating a method of driving a pixel circuit according to the present invention.

With combined reference to FIGS. 3 and 4, in the first period of time t1, each pixel 110 is initialized and receives a data signal provided by the corresponding data line. In the second period of time t2, writing of the data signal is terminated, and the threshold voltage of the drive transistor is sampled. In the third period of time t3, the pixel 110 emits light with a brightness level corresponding to the data signal to enable the display of an image.

As the pixel 110 incorporates pixel circuits 20 as defined above which allows the threshold voltage compensation and avoidance of an impact of the first power supply voltage VDD on brightness, possible changes in the power supply voltages or in the threshold voltages of the first thin-film transistors M1 will not affect the currents $I_{on}$ flowing through the organic light-emitting diodes OLED, and improved brightness uniformity of the AMOLED display device can be obtained.

In summary, in the pixel circuits and the methods for driving them, as well as the AMOLED display devices, according to the present invention, by initializing the anode of the OLED through the seventh thin-film transistor, aging of the OLED is slowed and the service life thereof is extended. In addition, as the current output by the first thin-film transistor which serves as a drive element is determined by the data voltage provided by the data line and the initializing voltage provided by the third power source and is independent of the external power supply voltages and the threshold voltage of the first thin-film transistor, brightness non-uniformity that may arise from variations in thin-film transistor threshold voltages and power supply voltage changes can be overcome. Therefore, use of the pixel circuits and the methods for driving them, as well as the AMOLED display devices, according to the present invention can result in not only service life extension but also an improvement in display quality.

The foregoing description is merely preferred embodiments of the present invention and does not limit the scope of the invention in any way. All changes and modifications made in light of the foregoing disclosure by those of ordinary skill in the art fall within the scope of the appended claims.

What is claimed is:

1. A pixel circuit, comprising:

a first thin-film transistor, which is connected between a second node and an anode of an organic light-emitting diode and has a gate directly connected to a first node;

a second thin-film transistor, which is connected between the first node and a third node and has a gate directly connected to an emission control line;

a third thin-film transistor, which is connected between the third node and a third power source and has a gate directly connected to an initialization control line;

a fourth thin-film transistor, which is connected between a first power source and the second node and has a gate directly connected to a scan line;

a fifth thin-film transistor, which is connected between a data line and the first node and has a gate directly connected to the scan line;

a sixth thin-film transistor, which is connected between the first power source and the second node and has a gate directly connected to the emission control line;

a seventh thin-film transistor, which is connected between the third power source and the anode of the organic light-emitting diode and has a gate directly connected to the initialization control line;

a first capacitor connected between the first node and the third node; and a second capacitor connected between the third node and the second node.

2. The pixel circuit of claim 1, wherein a cathode of the organic light-emitting diode is connected to a second power source; the first power source and the second power source are provided to drive the organic light-emitting diode; and the third power source is configured to provide an initialization voltage.

3. The pixel circuit of claim 2, wherein the initialization voltage is a negative voltage.

4. The pixel circuit of claim 1, wherein the first to the seventh thin-film transistors are all p-type thin-film transistors.

5. The pixel circuit of claim 1, wherein a current provided by the first thin-film transistor to the organic light-emitting diode is determined by a data voltage provided by the data line and an initialization voltage provided by the third power source and is independent of power supply voltages provided by the first power source and the second power source, as well as of a threshold voltage of the first thin-film transistor.

6. The pixel circuit of claim 1, wherein the fourth thin-film transistor and the fifth thin-film transistor are controlled via the scan line; the third thin-film transistor and the seventh thin-film transistor are controlled via the initialization control line; and the second thin-film transistor and the sixth thin-film transistor are controlled via the emission control line.

7. A method for driving a pixel circuit, the pixel circuit comprising: a first thin-film transistor, which is connected between a second node and an anode of an organic light-emitting diode and has a gate connected to a first node; a second thin-film transistor, which is connected between the first node and a third node and has a gate connected to an emission control line; a third thin-film transistor, which is connected between the third node and a third power source and has a gate connected to an initialization control line; a fourth thin-film transistor, which is connected between a first power source and the second node and has a gate connected to a scan line; a fifth thin-film transistor, which is connected between a data line and the first node and has a gate connected to the scan line; a sixth thin-film transistor, which is connected between the first power source and the second node and has a gate connected to the emission control line; a seventh thin-film transistor, which is connected between the third power source and the anode of the organic light-emitting diode and has a gate connected to the initialization control line; a first capacitor connected between the first node and the third node; and a second capacitor connected between the third node and the second node, wherein in the method, a scan period includes a first period of time, a second period of time and a third period of time, wherein in the first period of time, a scan signal provided by the scan line and a control signal provided by the initialization control line both shift from a high level to a low level and a control signal provided by the emission control line jumps from the low level to the high level, leading to the third thin-film transistor, the fourth thin-film transistor, the fifth thin-film transistor and the seventh thin-film transistor being turned on, a data voltage provided by the data line being supplied to the first node via the fifth thin-film transistor, and the third node and the anode of the organic light-emitting diode being initialized by the third power source;

in the second period of time, the control signal provided by the initialization control line is maintained at the low level, the control signal provided by the emission control line is maintained at the high level and the scan signal provided by the scan line shifts from the low level to the high level, leading to the fourth thin-film transistor and the fifth thin-film transistor being turned off, a writing of the data voltage being ended, and a sampling of a threshold voltage of the first thin-film transistor being completed; and in the third period of time, the scan signal provided by the scan line is maintained at the high level, the control signal provided by the initialization control line jumps from the low level to the high level and the control signal provided by the emission control line drops from the high level to the low level, leading to the third thin-film transistor and the seventh thin-film transistor being turned off, the second thin-film transistor and the sixth thin-film transistor being turned on, and the first thin-film transistor outputting a current which drives the organic light-emitting diode to emit light.

8. The method of claim 7, wherein in the first period of time, the first power source is connected to the second node via the fourth thin-film transistor, and a voltage at the second node is equal to the voltage provided by the first power source.

9. The method of claim 7, wherein in the third period of time, the first capacitor is shorted and a voltage difference between the gate and a source of the first thin-film transistor is equal to a voltage stored in the second capacitor.

10. The method of claim 7, wherein a cathode of the organic light-emitting diode is connected to a second power source; the first power source and the second power source are provided to drive the organic light-emitting diode; and the third power source is configured to provide an initialization voltage.

11. The method of claim 10, wherein the initialization voltage is a negative voltage.

12. The method of claim 7, wherein the first through the seventh thin-film transistors are all p-type thin-film transistors.

13. The method of claim 7, wherein a current provided by the first thin-film transistor to the organic light-emitting diode is determined by a data voltage provided by the data line and an initialization voltage provided by the third power source and is independent of power supply voltages provided by the first power source and the second power source, as well as of a threshold voltage of the first thin-film transistor.

14. The method of claim 7, wherein the fourth thin-film transistor and the fifth thin-film transistor are controlled via the scan line; the third thin-film transistor and the seventh thin-film transistor are controlled via the initialization control line; and the second thin-film transistor and the sixth thin-film transistor are controlled via the emission control line.

15. An active matrix organic light-emitting diode (AMOLED) display device, comprising a pixel circuit, wherein the pixel circuit comprises:

a first thin-film transistor, which is connected between a second node and an anode of an organic light-emitting diode and has a gate directly connected to a first node;

a second thin-film transistor, which is connected between the first node and a third node and has a gate directly connected to an emission control line;

a third thin-film transistor, which is connected between the third node and a third power source and has a gate directly connected to an initialization control line;

a fourth thin-film transistor, which is connected between a first power source and the second node and has a gate directly connected to a scan line;

a fifth thin-film transistor, which is connected between a data line and the first node and has a gate directly connected to the scan line;

a sixth thin-film transistor, which is connected between the first power source and the second node and has a gate directly connected to the emission control line;

a seventh thin-film transistor, which is connected between the third power source and the anode of the organic light-emitting diode and has a gate directly connected to the initialization control line;

a first capacitor connected between the first node and the third node; and a second capacitor connected between the third node and the second node.

16. The AMOLED display device of claim 15, wherein a cathode of the organic light-emitting diode is connected to a second power source; the first power source and the second power source are provided to drive the organic light-emitting diode; and the third power source is configured to provide an initialization voltage.

17. The AMOLED display device of claim 16, wherein the initialization voltage is a negative voltage.

18. The AMOLED display device of claim 15, wherein the first through the seventh thin-film transistors are all p-type thin-film transistors.

19. The AMOLED display device of claim 15, wherein a current provided by the first thin-film transistor to the organic light-emitting diode is determined by a data voltage provided by the data line and an initialization voltage provided by the third power source and is independent of power supply voltages provided by the first power source and the second power source, as well as of a threshold voltage of the first thin-film transistor.

20. The AMOLED display device of claim 15, wherein the fourth thin-film transistor and the fifth thin-film transistor are controlled via the scan line; the third thin-film transistor and the seventh thin-film transistor are controlled via the initialization control line; and the second thin-film transistor and the sixth thin-film transistor are controlled via the emission control line.

* * * * *